US010961817B2

(12) United States Patent
Haake et al.

(10) Patent No.: US 10,961,817 B2
(45) Date of Patent: Mar. 30, 2021

(54) ELECTROHYDRAULIC QUICK UNION FOR SUBSEA LANDING STRING

(71) Applicant: Halliburton Energy Services, Inc., Houston, TX (US)

(72) Inventors: Russell Stephen Haake, Dallas, TX (US); Stevan Jaye Sparks, Waxahachie, TX (US); Kenneth L. Schwendemann, Flower Mound, TX (US); Steven B. Scheibel, Dallas, TX (US); Benjamin Thomas Derryberry, Sanger, TX (US); Darrin Nathaniel Towers, Shady Shores, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 303 days.

(21) Appl. No.: 16/317,718

(22) PCT Filed: Feb. 20, 2018

(86) PCT No.: PCT/US2018/018770
§ 371 (c)(1),
(2) Date: Jan. 14, 2019

(87) PCT Pub. No.: WO2019/164474
PCT Pub. Date: Aug. 29, 2019

(65) Prior Publication Data

US 2021/0040815 A1 Feb. 11, 2021

(51) Int. Cl.
*E21B 34/04* (2006.01)
*E21B 17/02* (2006.01)
(Continued)

(52) U.S. Cl.
CPC ..... *E21B 34/04* (2013.01); *E21B 17/028* (2013.01); *E21B 41/0007* (2013.01); *E21B 47/06* (2013.01); *E21B 47/13* (2020.05)

(58) Field of Classification Search
CPC ..... E21B 34/04; E21B 17/028; E21B 47/13; E21B 47/06; E21B 41/0007; E21B 34/025; E21B 17/0283; E21B 17/0285
See application file for complete search history.

(56) References Cited

U.S. PATENT DOCUMENTS 3,134,613 A * 5/1964 Regan ..... E21B 33/06 285/123.5
4,648,627 A * 3/1987 Reimert ..... E21B 17/04 285/24

(Continued)

FOREIGN PATENT DOCUMENTS

WO 2010036437 A1 4/2010

OTHER PUBLICATIONS

PCT Application No. PCT/US2018/018770, International Search Report, dated Nov. 20, 2018, 3 pages.

(Continued)

*Primary Examiner* — James G Sayre
(74) *Attorney, Agent, or Firm* — Gilliam IP PLLC

(57) ABSTRACT

A system for serving as a connection interface between a lower landing string and an upper landing string is provided. The system includes a quick union device comprising a first quick union component that is operable to couple to the upper landing string and a second quick union component that is operable to couple to the lower landing string. The first quick union component and the second quick union component respectively include a self-aligning threading interface that provides hydraulic and electrical connections when the first and second quick union components are connected to one another. The quick union device provides real-time feedback via wireless communication transducers that measure pressure and report that the measured pressure is retained in a plurality of hydraulic lines of the second (Continued)

quick union component when the first and second quick union components are disconnected from one another.

20 Claims, 11 Drawing Sheets

(51) Int. Cl.
*E21B 47/06* (2012.01)
*E21B 47/13* (2012.01)
*E21B 41/00* (2006.01)

(56) References Cited

U.S. PATENT DOCUMENTS

| | | | | |
|---|---|---|---|---|
| 6,231,265 | B1 * | 5/2001 | Rytlewski | E21B 17/02 166/341 |
| 7,661,474 | B2 | 2/2010 | Campbell et al. | |
| 2003/0145994 | A1 * | 8/2003 | Gatherar | E21B 33/035 166/339 |
| 2004/0154390 | A1 * | 8/2004 | Baustad | E21B 47/01 73/152.55 |
| 2017/0152978 | A1 | 6/2017 | Leeth et al. | |

OTHER PUBLICATIONS

PCT Application No. PCT/US2018/018770, International Written Opinion, dated Nov. 20, 2018, 14 pages.

* cited by examiner

ELECTROHYDRAULIC QUICK UNION FOR SUBSEA LANDING STRING

BACKGROUND

Landing strings are installed within blowout preventer (BOP) stacks with offshore rigs on subsea wells in order to monitor, control, and seal the wells should pressure or flow situations demand. Landing strings are often installed as tubulars installed on the wellhead. A landing string may include various sensors, pressure containment components, valves and other components depending on the BOP design and the type of well. Many of these components am controlled hydraulically or electrically. Thus, the landing string may be coupled to an electrohydraulic control system and quick union. These quick unions can provide hydraulic control lines as well as electrical control lines to a landing string inside within or otherwise protruding through the BOP stack, and may be part of an assembly that includes a retainer valve, subsea test tree, tubing hanger running tool, tubing hanger, or any combination thereof.

Figure 1:
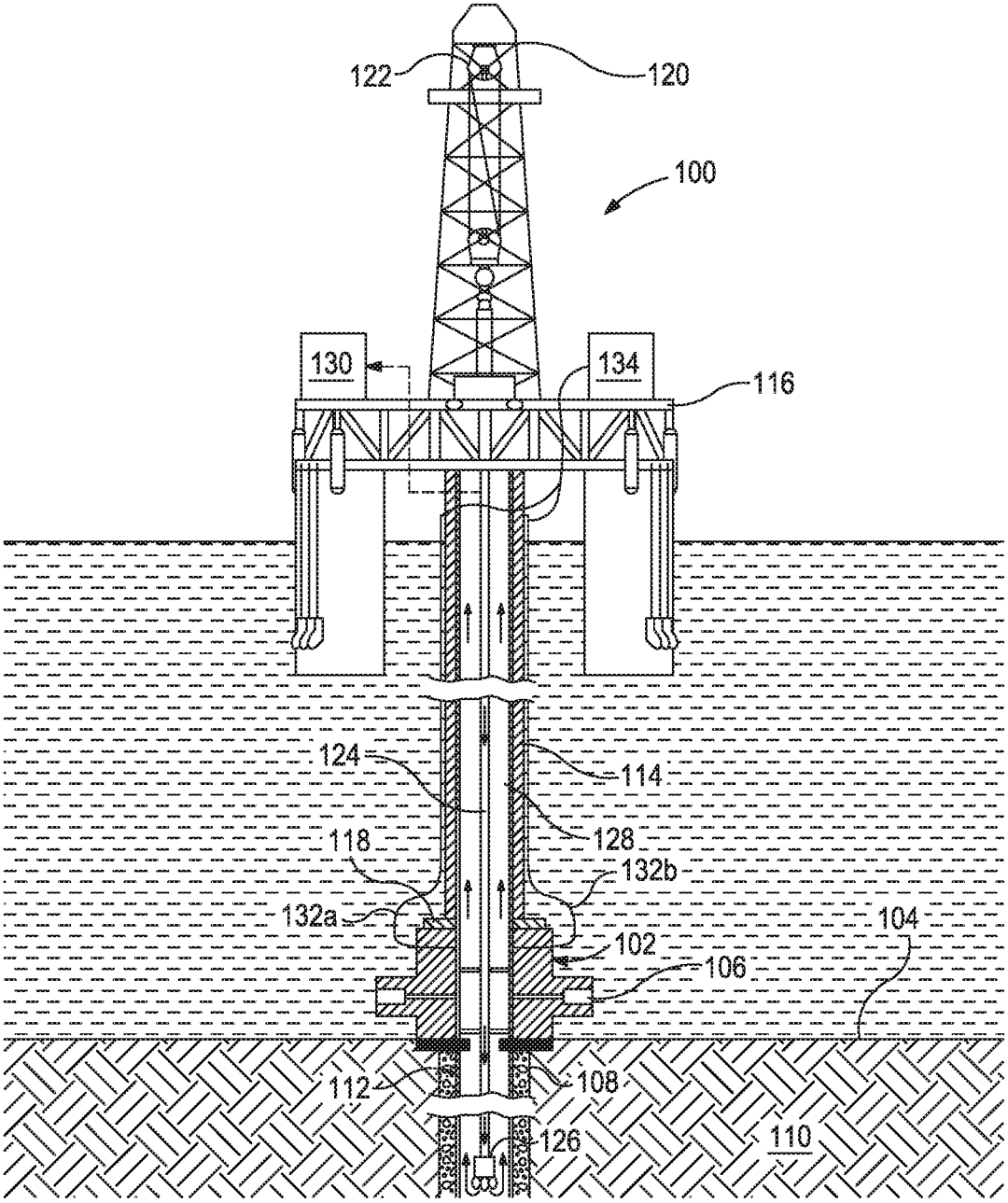
FIG. 1 illustrates a schematic of an offshore well completion facility.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

To run a completion, a landing string is used 1) to provide wellbore isolation, 2) to allow the BOP rams to seal without needing to cut pipe, 3) to provide function pressure for completion functions, and 4) to provide electrical connectivity. The addition of an electrohydraulic (EH) control module enables faster closure by means of storing a pressurized fluid accumulation immediately above the lower landing string (LLS), and also provides flow, pressure and temperature data through the landing string.

The addition of the EH control module may require that the landing string be split, however, due to size and lifting concerns. Subsequently, a single contiguous unit may not be built and tested on the rig floor. The upper landing string (ULS) and LLS may be built and tested separately, and then run-in-hole (RIH) one after another. A traditional quick union is typically used to mate the bores of the ULS and LLS. This may need all the hydraulic and electrical lines between the ULS and LLS to be connected while the LLS is suspended in the rotary table. This suspension occurs by means of a c-plate. This suspension also may require pressure to be maintained on the latch lines to reduce the risk of an unintended unlatch. Confirmation that this pressure has been applied and locked in is a valuable safety upgrade.

The present disclosure provides for a stabbable quick union (SQU) that simplifies the operational issues discussed above. For example, the SQU is a two piece assembly with a self-aligning threading interface on each piece that provides hydraulic and electrical connections when assembled. The quick union also provides a real-time feedback via wireless communication transducers that monitor pressure and report whether the pressure is retained in the hydraulic lines when the quick union units are disconnected.

By using hydraulic and electrical stabs, which mate up simultaneous to the main bore mate up, the need to align and test individual lines is removed. An intrinsic hydraulic lock in the valve provides the ability to apply latch assist pressure on up to an arbitrary number of lines (e.g., 4 lines) without having to connect the umbilical. Pressure can be applied, then locked in, and then the line(s) used to apply this pressure are disconnected. Pressure in latch assist lines is confirmed by means of wireless communication based (e.g., BLUETOOTH) pressure transducers.

The present disclosure provides several advantages over traditional quick union devices. For example, the quick union of the subject technology can save time when mating up the ULS to the LLS when the LLS is suspended in the rotary table. The quick union is intended to 1) self-align in order to improve ease of making up connection in suboptimal offshore conditions, 2) remove the need to connect and subsequently test hydraulic lines between the ULS and LLS, thus saving time (e.g., many hours) and removing human error opportunities, 3) permit an electrical connection to be made, which does not require external cabling, 4) enable pressure to be applied, maintained and confirmed on latch assist lines to tubing hanger running tool and upper ball open through intrinsic isolation valve and wireless communication transmissible pressure transducers, 5) reduce pull-out-of-hole (POOH) and rig-down time, and 6) provide latch assist assurance when disconnecting the ULS from the LLS during POOH/rig-down.

Referring to FIG. 1, illustrated is an exemplary offshore facility 100 that may employ the systems and methods generally described herein. As illustrated, the completion facility 100 is a semi-submersible offshore oil and gas platform, but may equally be replaced with any type of offshore drilling unit including, but not limited to submersible platforms or rigs, jack-up rigs, offshore support vessels, offshore production platforms, or the like. The completion facility 100 may be generally centered over a subsea wellhead installation 102 located on the sea floor 104. The wellhead installation 102 may include one or more blowout preventers 106 and, in some embodiments, the wellhead installation 102 itself may be generally characterized or otherwise referred to herein as a blowout preventer. In some aspects, the wellhead installation 102 includes one or more of a retainer valve, a safety tree, slip joint, cross-overs, top joints, or a combination thereof.

As depicted, a wellbore 108 extends below the wellhead installation 102 and has been drilled through various earth strata 110 in order to provide access to one or more subterranean hydrocarbon formations (not shown). A casing string 112 has been cemented within the wellbore 108 and generally seals the wellbore 108 along its longitudinal length.

A subsea conduit or marine riser 114 extends from the rig floor or deck 116 of the completion facility 100 to the wellhead installation 102 at the sea floor 104. In some embodiments, a flex joint 118 may be installed on or otherwise form part of the wellhead installation 102 and provide a flexible coupling for sealingly connecting the marine riser 114 to the wellhead installation 102. As the sea currents change, or as the completion facility 100 undergoes rig heaving, the marine riser 114 shifts in response thereto and the flex joint 118 provides an amount of flexure that maintains a sealed connection between the marine riser 114 and the wellhead installation 102.

In a drilling mode, the completion facility 100 has a derrick 120 and a hoisting apparatus 122 for raising and lowering pipe strings, such as a work string 124 (referred to as a "drilling string" in the drilling mode), into and out of the riser 114 and the wellbore 108. Those skilled in the art will readily recognize that various tools, sensors, and other equipment may be coupled to the work string 124 in order to undertake required drilling operations designed to extend the wellbore 108 and thereby access subterranean hydrocarbon formations (not shown). For example, a drill bit 126 may be attached to the end of the work string 124 and used to cut or otherwise drill through the earth strata 110. In some drilling operations, a drilling fluid or mud is pumped down the work string 124 to the drill bit 126 to keep the drill bit 126 cool and clean during drilling operations, and may also be used to transmit hydraulic energy to various downhole tools and measuring devices. The drilling fluid also serves to circulate cuttings and debris back to the surface through the annulus 128 defined between the work string 124 and the wellbore 108 and/or marine riser 114. The circulated cuttings and debris are eventually deposited in a mud pit 130 located at the completion facility 100 where the drilling fluid is reconditioned for recycling and reuse.

In a completion mode, the drilling string (e.g., 124) is pulled out, and substituted with a completion string (e.g., 124). The completion facility 100 may further include one or more hydraulic lines 132*a* and 132*b* that extend from the rig floor 116 to the wellhead installation 102. At the rig floor 116, the hydraulic lines 132*a,b* may be coupled to one or more high-pressure rig pumps 134 (one shown) configured to provide hydraulic pressure to the hydraulic lines 132*a,b*. In some embodiments, the hydraulic lines 132*a,b* may be booster lines or choke/kill lines used to regulate the fluid pressure within the wellhead installation 102 and the annulus 128. As discussed in greater detail below, however, the hydraulic lines 132*a,b* may also be used to provide the hydraulic pressure necessary to displace the drilling fluid from the marine riser 114 when it is desired to disconnect the marine riser 114 from the wellhead installation 102.

The purpose of a subsea landing string (e.g., 114) is to provide wellbore isolation by opening and shutting ball valves in the landing string assembly. If something wrong occurs downhole, the system can be shut in. In some embodiments, there is a latch in the landing string assembly that allows to shut in of the wellhead and then disconnection of the landing string assembly from a BOP stack (e.g., 106) and which allows the landing string assembly to float away to safety. This is typically done when there is bad weather or there are ball valve control issues.

An EH system (not shown) can enhance the speed with which the well head can be closed, and the EH can provide electricity to the landing string assembly. This would allow data such as flow properties, pressure and temperature to be transmitted through the landing string assembly. The purpose of the EH is to transmit data to the downhole environment, to add a user interface to the system, and to decrease the closure time for improved safety function. The data that is retrieved from the EH is useful for completion operations.

The EH system aids the downhole equipment by quickly closing and unlatching before the riser package (e.g., 114) disconnects. In traditional subsea applications, a pump from the surface (e.g., over 10,000 feet in length from the rig floor) is used, however, the hydraulic flow rate would be significantly lower and thereby resulting in a significantly slow response in the closing operation. For example, the basic functionality of the EH in order to close all of the ball valves, would necessitate pumping fluid through a 1.5 mile long of ¼ inch tubing line in order to fill and pressurize piston chambers that operate to move the ball valves into a shut-in position. However, if the EH system is placed directly over the downhole equipment, that same amount of accumulated pressure can cause the system to shut faster. With the EH, there is a significantly large reservoir of pressurized fluid and gas that can release the accumulated flow of fluid and gas. The fluid may move into the closed piston chambers and cause the ball valves to close rather quickly.

Typically, the landing string assembly, depending on whether the assembly has a relatively large bore diameter (e.g., greater than 6 inches) or a relatively small diameter (e.g., about a 3-inch bore diameter), can be about 45-50 feet in length from either the running tool or the fluid hanger up to the top of the annular slick joint. In some embodiments, the EH is positioned above a quick union system. The EH in a 3-inch bore application is about 12 feet in length, and for a large bore application, the EH is about 22 feet in length. If these components are stacked on one landing string, the assembly becomes a significantly longer system (e.g., about 80-90 feet).

When there are weather instances or mechanical instances that can cause the rig (e.g., 100) to become offset relative to the well (e.g., 102) at an offshore jobsite, there has to be a mechanism to be able to disconnect the inner string (e.g., 124), and also disconnect the upper riser package (e.g., an upper landing string) from the BOP stack (e.g., 106) in a safe and expedient manner.

The subject technology relates to a hydraulic control system, typically found on the surface, which has been condensed and introduced downhole and positioned directly on top of the safety equipment. The subject technology provides for a stabbable quick union that can serve as a connection interface between the LLS and the ULS. Each of the landing string components can be separated into individual units, but can be quickly assembled back with minimal testing. In traditional systems, the same connection is made, but manual hoses would need to be run and then the individual unit assembled on the rig floor (e.g., 116). In some embodiments, hydraulic line tests, bore tests, etc., are performed. These conventional operations take a significant amount of time.

The subject technology provides for a quick way to stab with hydraulic communication to test each landing string separately, so when the individual landing strings are recoupled together, there are no additional line tests or need to connect hoses, etc., while on the rig floor (e.g., 116). The purpose of the subject technology is to allow a subsea landing string to disconnect from the well safely, isolate the well due to weather and/or mechanical events, move the landing string assembly back on-center, and reposition the landing string assembly back on the well in order to not lose the downtime of conveying pipe from the surface.

The subject technology is able to isolate the well (e.g., using the ball valves), seal the well using the retainer valve to prevent marine riser contents to dump out, and thereafter allowing the BOP stack package (e.g., 106) to disconnect safely from the ULS. In some aspects, it may seem as two systems working separately, but the quick union components work in conjunction at the same time. The EH may close the ball valves, close the retainer valve, unlatch the safety tree, allow the riser package to be pulled up, and then disconnect the riser package. Once the riser package is taken off the well, the rig is allowed to move off center. The operators of the rig would not have to retrieve the equipment at the surface, which would take several days to run out of the hole and run back in the hole.

Figure 2:
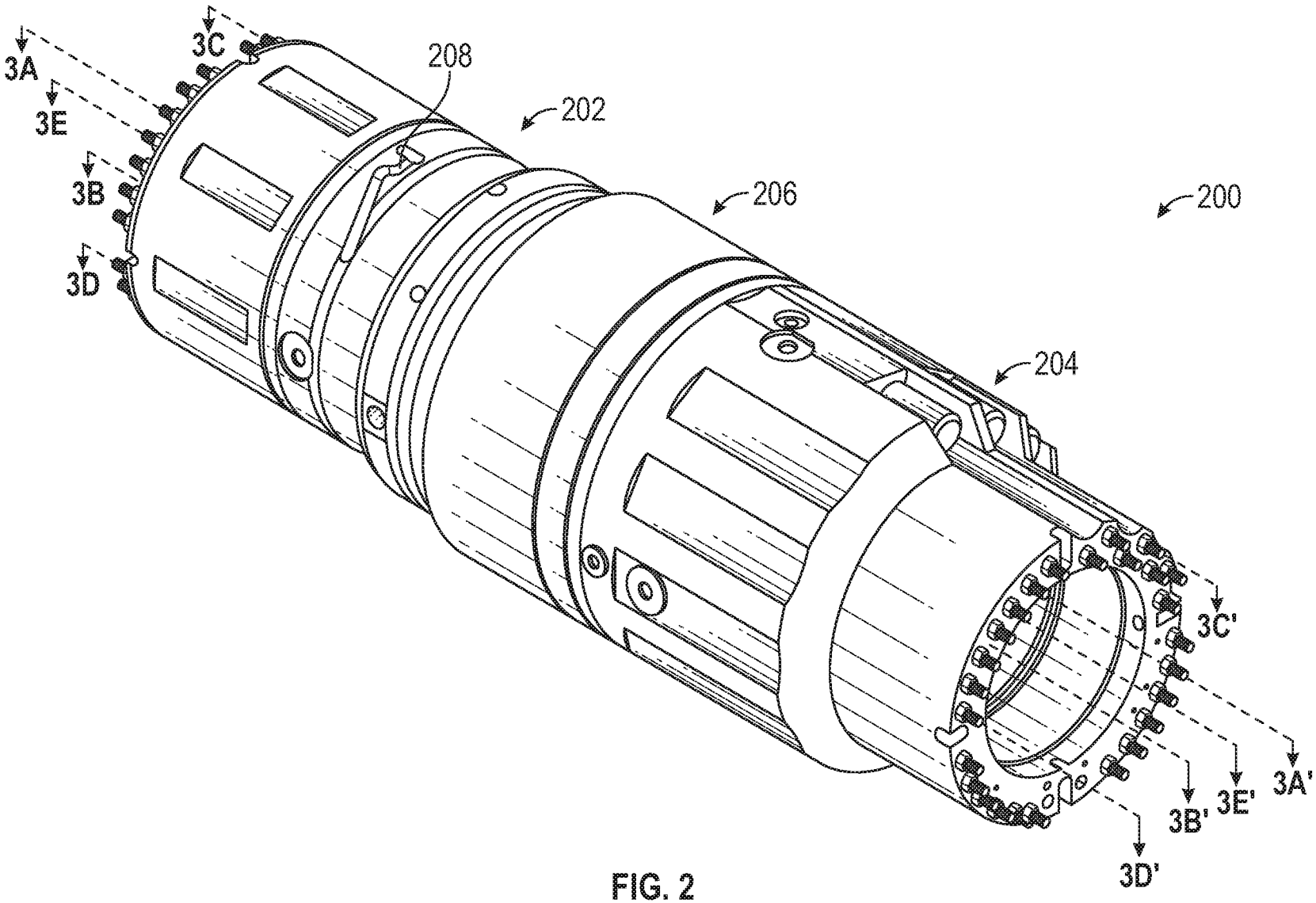
FIG. 2 illustrates a perspective schematic view of a stabbable quick union in accordance with one or more implementations of the subject technology.

FIG. 2 illustrates a perspective schematic view of a stabbable quick union 200 in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

The stabbable quick union 200 includes a first quick union component 202, a second quick union component 204, and a load collar 206. The first quick union component may be referred to as the upper SQU, and the second quick union component may be referred to as the lower SQU. The SQU 200 serves as a connection interface between a lower landing string and an upper landing string. In this respect, the ULS and LLS each can be mechanically coupled to a respective quick union component. For example, the first quick union component 202 is coupled to the ULS and the second quick union component 204 is coupled to the LLS. Referring back to FIG. 1, the stabbable quick union 200 may be positioned in or otherwise form part of the blowout preventer 106 in some implementations.

As depicted in FIG. 2, the first quick union component 202 is mechanically coupled to a first end of the load collar 206 at a first end (or bottom end) of the first quick union component 202. The second quick union component 204 is mechanically coupled to a second end of the load collar 206 at a first end (or top end) of the second quick union component 204.

The load collar 206 that mechanically couples the first quick union component to the second quick union component. The load collar 206 includes plugs (not shown) arranged circumferentially about an inner surface of the load collar 206 that allows the load collar 206 to traverse a portion of the first quick union component 202 along a longitudinal length of the first quick union component 202 and become positioned onto a curved profile 208 on an outer surface of the first quick union component 202. The load collar 206 may be mechanically fastened to the first quick union component 202 and detached from the second quick union component 204 such that the first quick union component 202 can be disconnected from the second quick union component 204 when the plugs are arranged within the curved profile 208.

In some implementations, the first quick union component 202 and the second quick union component 204 respectively include a self-aligning threading interface that provides hydraulic and electrical connections when the first and second quick union components (e.g., 202, 204, respectively) are connected to one another.

The quick union device also provides real-time feedback via wireless communication transducers that measure pressure and report that the measured pressure is retained in hydraulic lines of the second quick union component 204 when the first and second quick union components (e.g., 202, 204, respectively) are disconnected from one another.

Prior to deployment at the workshop (e.g., at an onshore testing facility), the EH (e.g., about 22 feet in length and about 13,000 lbs in weight) is mechanically coupled to the stabbable quick union (e.g., 200) at the bottom of the EH. The lower landing string (safety tree, retainer valve, slip joint, cross-overs, top joints) may be mechanically coupled to the bottom portion (e.g., 204) of the quick union which terminates into a tubing hanger running tool (THRT).

Lines are run outside of the outer diameter (OD) of the landing string assembly and the quick union (e.g., 200) to perform through-line tests. There are ball valves that have to open and close, and have a completion function performed to notify the THRT and other downstream tools when to shift the ball valves to open/close and latches to open/close. All subsea equipment has circumferentially oriented ports. It is important to test the ports. Testing lines upstream from the EH to the lower landing string can be done by running hoses inside the bore. Also, electrical tests can be performed using the EH, which provides electrical capability down in the landing string assembly. At the offshore rig (e.g., at the rig floor 116), the tests performed onshore can be repeated as necessary.

FIGS. 3A-3E illustrate different cross-sectional views of the stabbable quick union 200 in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein.

Additional components, different components, or fewer components may be provided.

Figure 3C:
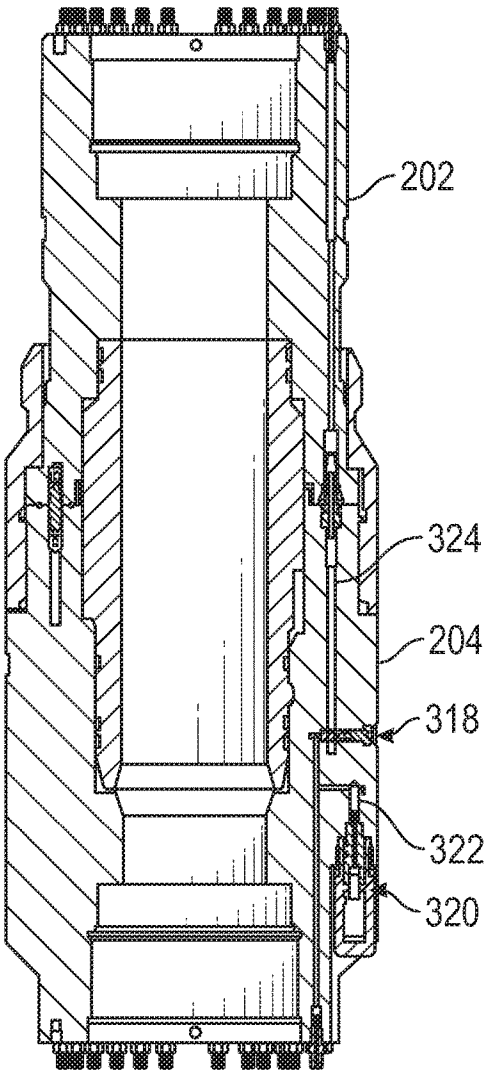
FIGS. 3A-3E illustrate different cross-sectional views of the stabbable quick union in accordance with one or more implementations of the subject technology.
Figure 3B:
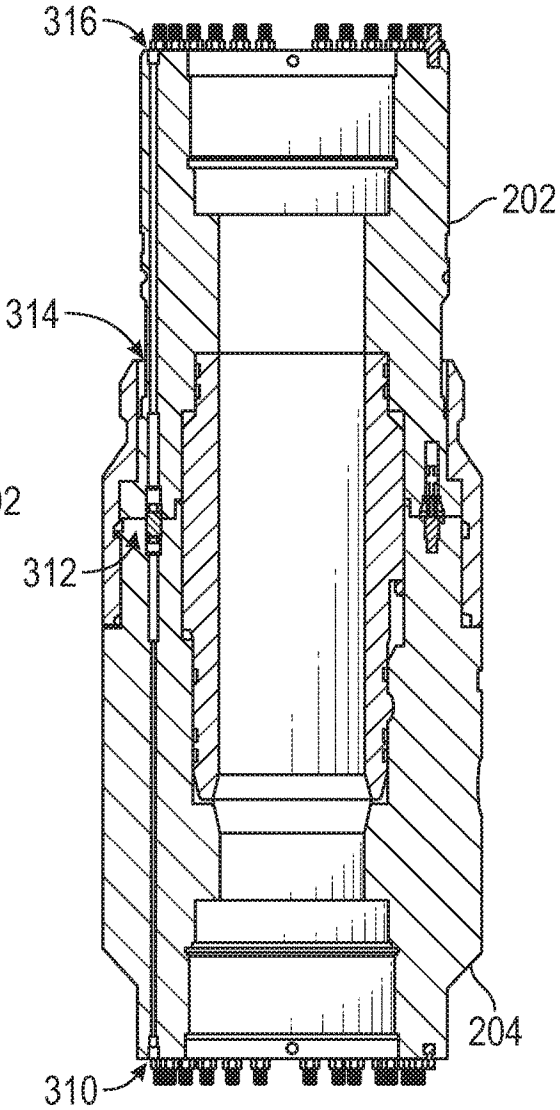
Figure 3A:
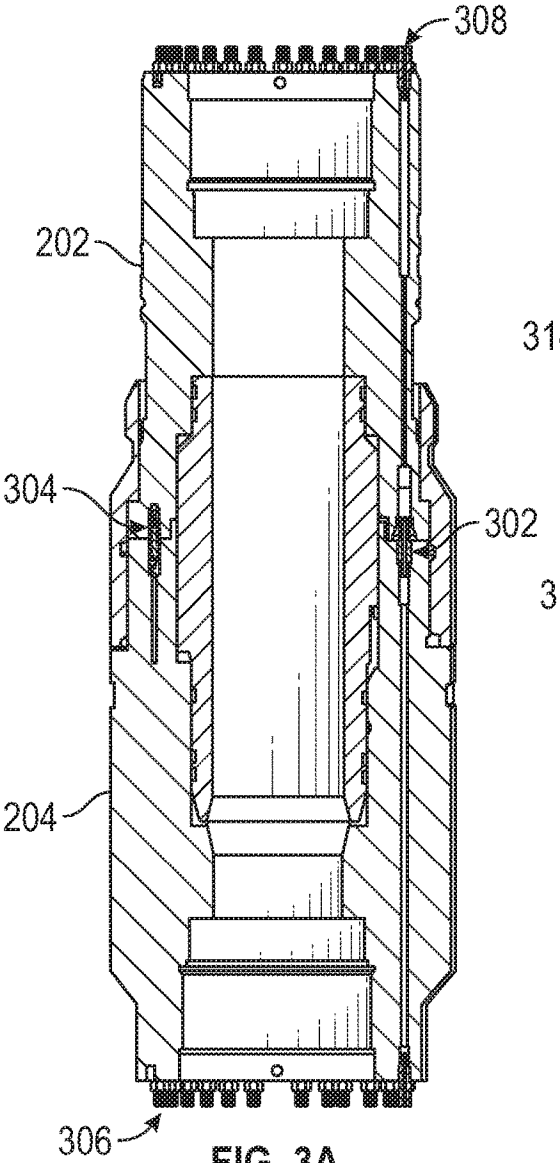

As depicted in FIG. 3A, the first quick union component 202 is mechanically coupled to the second quick union component 204. The coupling between the first quick union component 202 and the second quick component 204 is non-permanent such that the first quick union component 202 can be disconnected (or detached) from the second quick union component 204), and be reconnected.

The SQU 200 includes hydraulic line ports that protrude and are arranged on a radially repeating pattern near the circumferential edges at one end of the first quick union component and the second quick union component. For example, the first quick union component 202 includes hydraulic line ports 308 on a top end of the first quick union component 202. The opposite end (or bottom end) of the first quick union component 202 includes female end ports (e.g., 304) configured to receive counterpart hydraulic line ports from the second quick union component 204. In some implementations, the second quick union component 204 includes hydraulic line ports 302 on a top end of the second quick union component 204 that mates with the bottom end of the first quick union component 202. The second quick union component 204 also includes hydraulic line ports 306 on a bottom end of the second quick union component 204.

For connection, the first and second quick union components (e.g., 202, 204, respectively) are operable to be stabbed together with hydraulic communication to test each of the upper landing string and the lower landing string separately. For example, the hydraulic line ports arranged on a radially repeating pattern near a top circumferential edge of the second quick union component 204 can be positioned and received by the female-end ports arranged on a radially repeating pattern near a bottom circumferential edge of the first quick union component 202. In other implementations, hydraulic line ports arranged on a radially repeating pattern near a bottom circumferential edge of the first quick union component 202 can be positioned and received by the female-end ports arranged on a radially repeating pattern near a top circumferential edge of the second quick union component 204.

In some implementations, the lower landing string (not shown) is mechanically coupled to the bottom end of the second quick union component 204. In this respect, the hydraulic line ports 306 may be positioned and received by female-end ports on a top end of the lower landing string. The lower landing string may terminate into a tubing hanger running tool near the wellhead installation (e.g., 102).

In some implementations, an electrohydraulic device (not shown) is mechanically coupled to the top end of the first quick union component 202 at a first end (or bottom end) of the electrohydraulic device. In this respect, the hydraulic line ports 308 may be positioned and received by female-end ports on the bottom end of the electrohydraulic device. The electrohydraulic device may be mechanically coupled to the upper landing string at a second end (or top end) of the electrohydraulic device.

As depicted in FIG. 3B, electrical ports 312 arranged radially near a top circumferential edge of the second quick union component 204 can connect to counterpart ends (e.g., 314) arranged radially near a bottom circumferential edge of the first quick union component 202 to establish an electrical connection between the lower landing string and the upper landing string through the first and second quick union components when the first and second quick union components are mated. For example, the first quick union component 202 includes electrical ports 316 on the top end of the first quick union component 202 that can connect to the bottom end of the electrohydraulic device to establish an electrical connection with the electrohydraulic device. The second quick union component 204 includes electrical ports 310 on the bottom end of the second quick union component 204 that can connect to the top end of the lower landing string to establish an electrical connection with the lower landing string.

As depicted in FIG. 3C, hydraulic pressure can be applied through the second quick union component 204 to run a check valve test to prevent loss of fluids when an electrohydraulic device and upper landing string mechanically coupled to the first quick union component 202 are held vertical prior to a RIH operation. In some aspects, the applied hydraulic pressure is locked by a valve 318 operably coupled to a latch assist line 322. The valve (e.g., 318) for each of the hydraulic lines (e.g., 324) can be opened to allow hydraulic fluid to transfer between the first quick union component 202 and the second quick union component 204. The hydraulic pressure on each of the hydraulic lines (e.g., 324) may be equalized across the latch assist line 322 and through the first and second quick union components (e.g., 202, 204, respectively) to complete a connection.

The second quick union component 204 includes a transducer 320 positioned in a housing along an outer surface of the second quick union component 204. In some aspects, the latch assist line 322 is communicably coupled to the transducer 320. In some implementations, the transducer 320 is configured to obtain one or more measurements (e.g., hydraulic pressure data, temperature data or fluid properties) from the latch assist line 322. The transducer 320 is also configured to send the obtained one or more measurements over a wireless network. For example, the one or more measurements are sent to a client device connected to the wireless network. In some aspects, the one or more measurements associated with the latch assist line 322 are broadcast via the transducer 320.

Figure 3E:
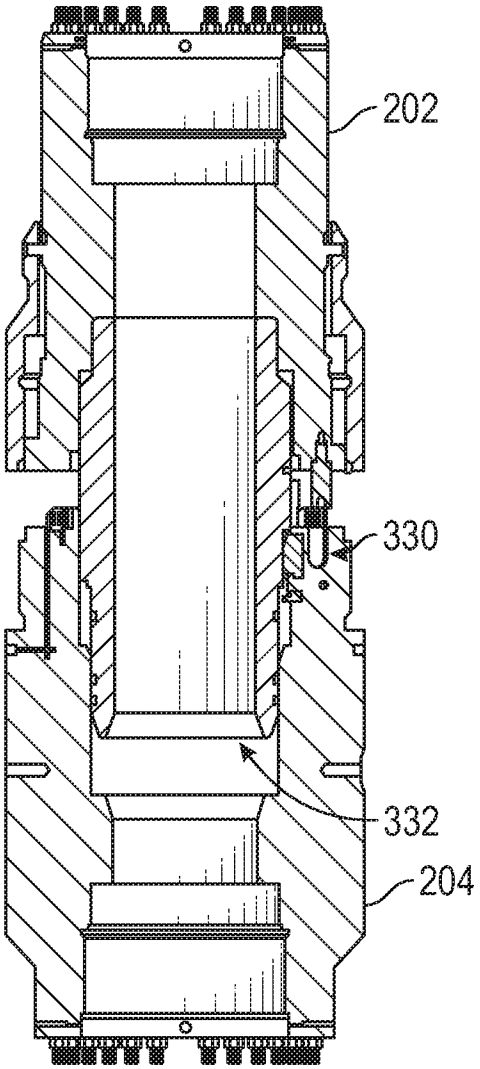
Figure 3D:
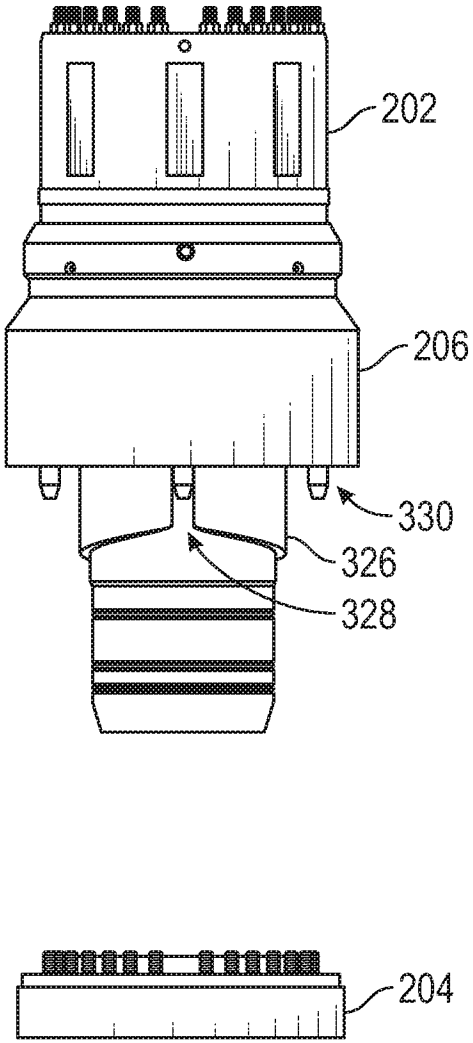

As depicted in FIGS. 3D and 3E, the first quick union component 202 includes a mandrel 326 located within a bore 332 of the first quick union component 202. In some aspects, an outer diameter of the mandrel 326 has a splined feature 328 that provides coarse rotational alignment between the first quick union component 202 and the second quick union component 204. The second quick union component 204 includes torque stabs 330 arranged on a radially repeating pattern near a top circumferential edge of the second quick union component 204 that provide fine rotational alignment between the first quick union component 202 and the second quick union component 204.

In some aspects, the splined profile 328 allows the mandrel 326 to align rotationally with an inner surface of the second quick union component 204 when the first quick union component 202 is positioned about the second quick union component 204. In some implementations, the splined profile 328 of the mandrel 326 engages an alignment key (not shown) positioned on the inner surface of the second quick union component 204 that causes the mandrel 326 to rotate within the inner surface of the second quick union component 204 until the alignment key is locked into place within the splined profile 328.

Figure 4B:
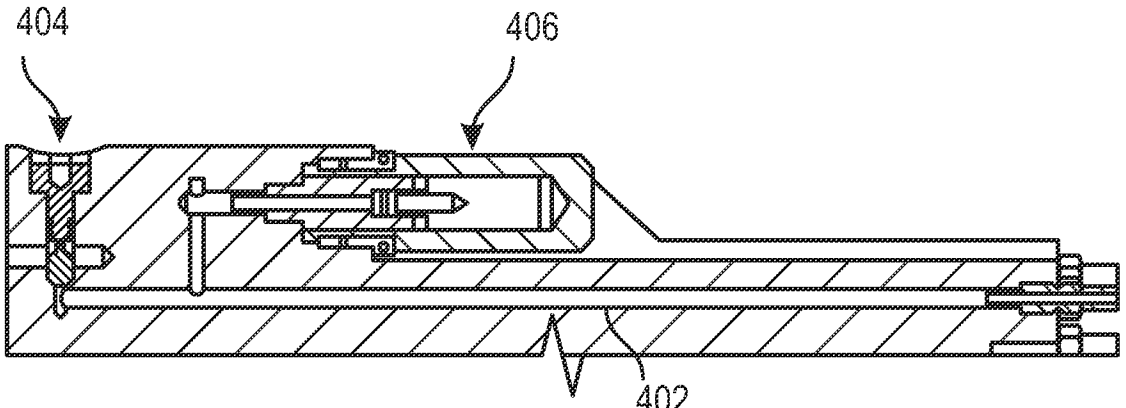
FIGS. 4A and 4B illustrates side schematic view of the stabbable quick union and a cross-sectional view of a transducer in the stabbable quick union, respectively, in accordance with one or more implementations of the subject technology.
Figure 4A:
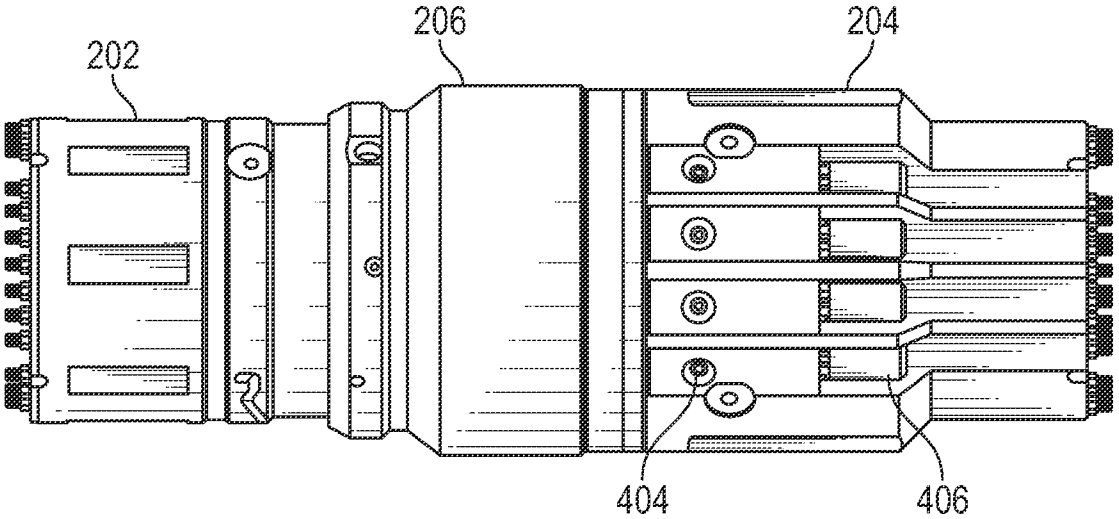

FIGS. 4A and 4B illustrate a side schematic view of the stabbable quick union 200 and a cross-sectional view of a transducer 406 in the stabbable quick union 200, respectively, in accordance with one or more implementations of the subject technology. Not all of the depicted components may be used, however, and one or more implementations may include additional components not shown in the figure.

Variations in the arrangement and type of the components may be made without departing from the spirit or scope of the claims as set forth herein. Additional components, different components, or fewer components may be provided.

The lower landing string has a couple of unique properties: 1) pressure should be applied (generally referred to as latch assist) to hold the upper ball valve of the safety tree open, and 2) holding the upper ball valve open also prevents the lower landing string from becoming unlatched mechanically (when pressure is applied). Unlatching generally refers to the separation of the lower landing string completely from the upper landing string.

In some implementations, pressure is applied to a latch assist line 402 through the upper SQU (e.g., 202). The applied pressure can be locked at a valve 404.

Traditionally, if pressure is locked at a valve, there has been no mechanism to verify that there is pressure locked in the line without attaching a gauge to the line, which is inconvenient because the outer diameter (OD) of the lower SQU 204 becomes very close to the inner diameter (ID) of the c-plate mouth that it traverses. In this respect, items may not be positioned on the circumference of the OD of the lower SQU 204.

As depicted in FIG. 4B, a transducer 406 with wireless communication capability (e.g., BLUETOOTH transducers) is positioned in a housing that can survive a significant amount of pressure. In some implementations, the housing is formed of a radio frequency-transparent material. The latch assist line 402 is communicably coupled to the transducer 406, which can communicate with another tool upstream. In some implementations, the measured pressure is broadcast on that line via the transducer 406, and the measured pressure can be read from a client device connected over a wireless network (e.g., BLUETOOTH, WIFI).

In some implementations, the transducer 406 is configured to transmit raw data (e.g., pressure, temperature) over the wireless network. In some implementations, the rate at which the transducer 406 transmits the data is reconfigurable. For example, the transducer 406 can transmit the data once per second.

Once the pressure is locked by the latch assist, the line can be bled from a pump, and then the line can be disconnected.

Figure 5A:
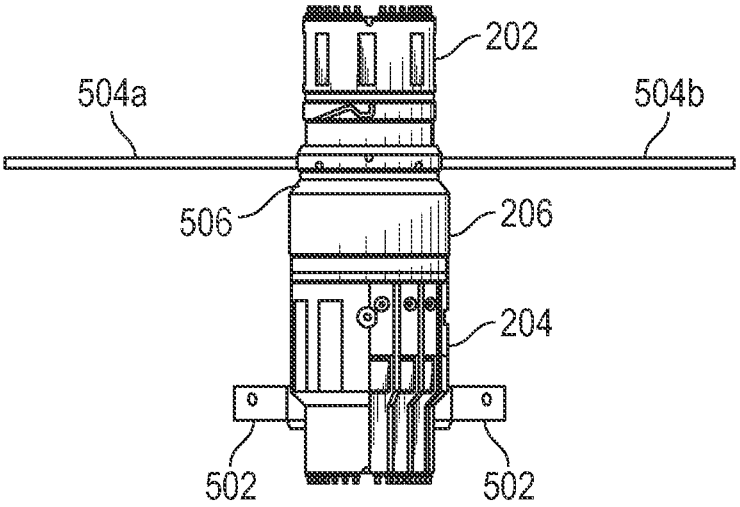
FIGS. 5A and 5B illustrate schematic views of the stabbable quick union on a rotary table in accordance with one or more implementations of the subject technology.
Figure 5B:
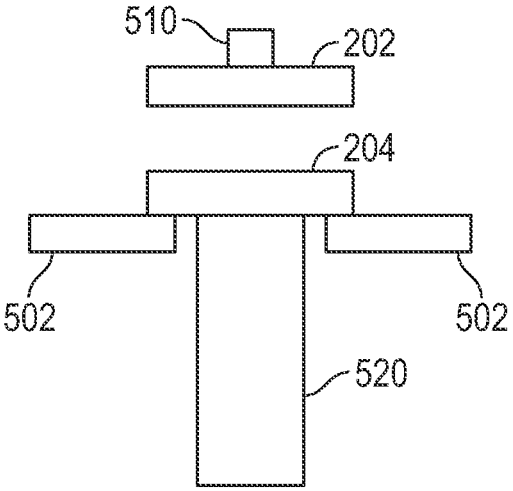

FIGS. 5A and 5B illustrate schematic views of the stabbable quick union 200 on the c-plate 502 of a rotary table in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

Prior to deployment, the SQU 200 sits on a c-plate 502 of a rotary table on the rig floor 116. The c-plate 502 has a mouth that allows a first diameter of the lower SQU 204 to mount inside the inner diameter of the c-plate 502 mouth, but does not allow a second diameter of the lower SQU 204 (that is greater than the first diameter) to pass through the c-plate 502 mouth.

In some aspects, torque bars 504*a*. 504*b* are connected onto the load collar 206. The load collar 206 is mechanically coupled to the upper and lower SQUs (e.g., 202, 204, respectively) that keep the upper and lower SQUs coupled to one another. In operation, the load collar 206 is rotated to disconnect the upper SQU 202 from the lower SQU 204.

The load collar 206 has plugs arranged circumferential about the inner surface of the load collar 206, which allows the load collar 206 to traverse a portion of the upper SQU 202 along a longitudinal length of the upper SQU 202 and become positioned onto a curved profile 506 on the outer surface of the upper SQU 202. Once the plugs reach inside the curved profile 506, the load collar 206 becomes mechanically fastened to the upper SQU 206 (and detached from the lower SQU 204) such that the upper SQU 202 can be disconnected from the lower SQU 204. For example, in some embodiments, the curved profile 506 includes a groove where the plug of the load collar 206 can traverse the shape of the groove until the plug reaches a resting position in the curved profile 506 and thereby become locked into position by virtue of the curved profile 506.

As depicted in FIG. 5B, there is locked hydraulic pressure in the lines, and the lower landing string 520 can be picked up using a lifting cap 510. The lifting cap 510 is mechanically coupled to the upper SQU 202. Elevators can be positioned on the lifting cap 510 for lifting and conveying pipe from one location to another location. The lifting cap 510 may have a relatively long neck with a large diameter at the top that decreases to a smaller diameter, and that mounts inside the elevator.

Figure 6:
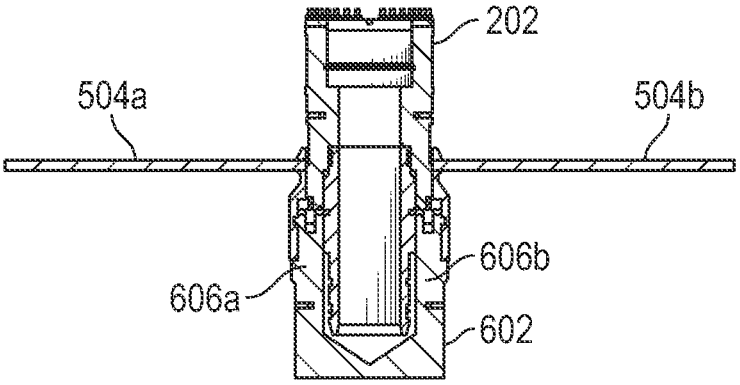
FIG. 6 illustrates a schematic view of an upper portion of the stabbable quick union disconnected from a lower portion of the stabbable quick union in accordance with one or more implementations of the subject technology.

FIG. 6 illustrates a schematic view of an upper portion 202 of the stabbable quick union 200 disconnected from a lower portion 204 of the stabbable quick union 200 in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

As depicted in FIG. 6, the disconnected upper SQU 202 can be repositioned into a base component for storage also referred to as a "flower pot" 602 that has receptacles 606*a*, 606*b* designed to receive the upper SQU 202. The upper SQU 202 may not be needed until a pull-out-of-hole (POOH) event is triggered. The borehole and exposed connections are then covered.

Figure 7A:
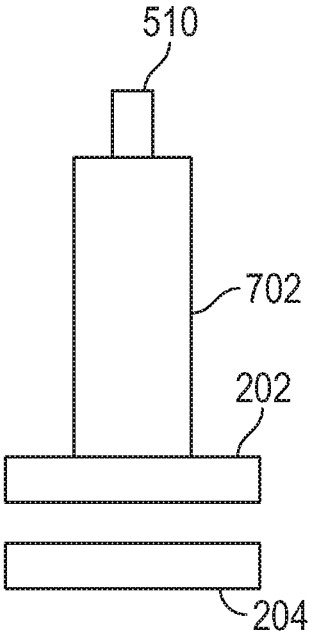
FIGS. 7A and 7B illustrate schematic views of the stabbable quick union connected to an electrohydraulic system in accordance with one or more implementations of the subject technology.
Figure 7B:
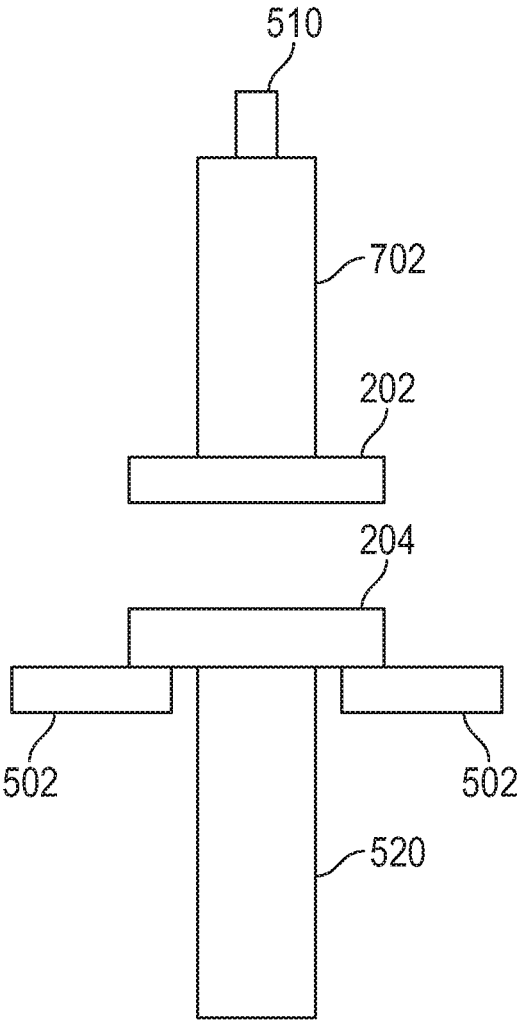

FIGS. 7A and 7B illustrate schematic views of the stabbable quick union 200 connected to an electrohydraulic system 702 in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

Referring to FIG. 7A, the upper SQU 202 and EH 702 are coupled together for part of the testing. The EH 702 and upper SQU 202 can be lifted using the lifting cap 510 coupled to the top of the EH 702. The upper SQU 202 can be moved relative to the lower SQU 204.

As depicted in FIG. 7B, while on the c-plate 502 on the rotary table, the lower SQU 204 is projecting upward. For reconnection, the upper SQU 202 is repositioned to be mated with the lower SQU 204 using the lifting cap 510 (conveyed by the elevator). For example, the upper SQU 202 is moved over the rig center. In some embodiments, weight is set down and the lower SQU 204 is disconnected on the pipe deck (e.g., 116). In some implementations, the upper SQU 202 is aligned using a stab guide. Electrical connector protectors placed over the electrical ports near the upper and lower SQU circumferential edges are removed. Once aligned, the upper SQU 202 is set down on the lower SQU 204, and the connection can be completed.

Figure 8A:
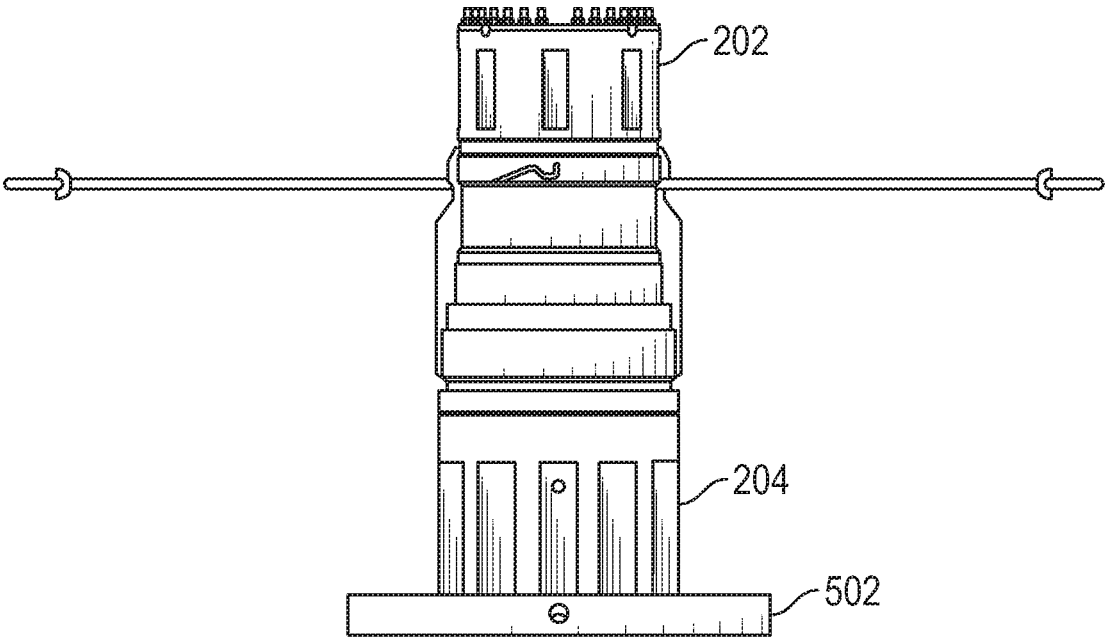
FIGS. 8A and 8B illustrate schematic views of the upper and lower portions of the stabbable quick union reconnected in accordance with one or more implementations of the subject technology.
Figure 8B:
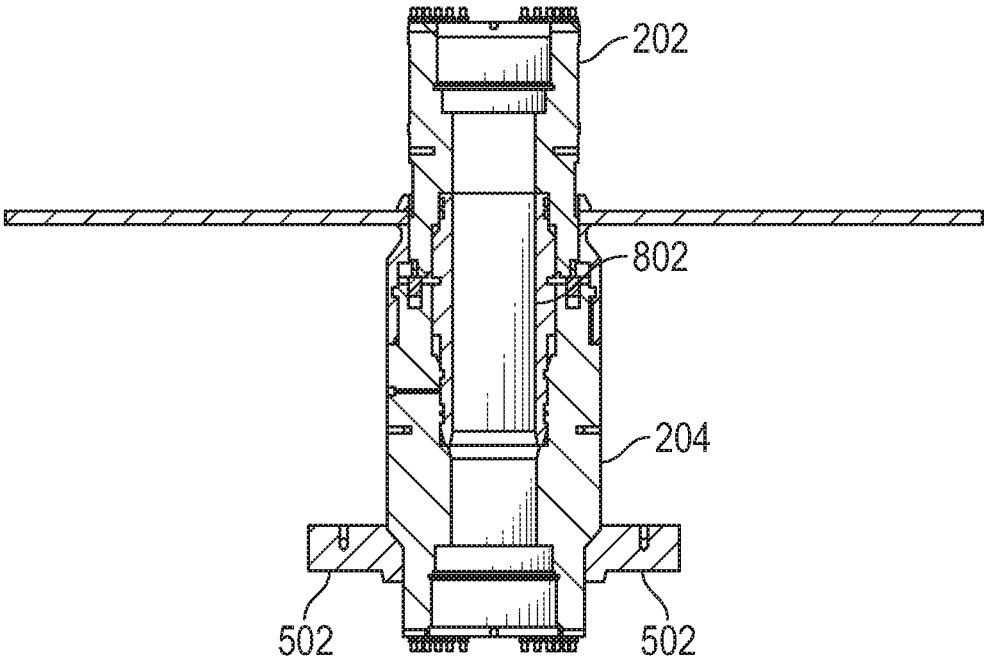

FIGS. 8A and 8B illustrate schematic views of the upper and lower portions 202, 204 of the stabbable quick union 200 reconnected in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

To make up the connection, collar retention pins can be loosened and torque bars (e.g., 504*a*, 504*b*) are installed. As depicted in FIG. 8A, the torque bars 504*a*, 504*b* are connected onto the load collar 206. In operation, the load collar 206 is rotated (e.g., clockwise) to connect the upper SQU 202 to the lower SQU 204. For example, rig operators cause the torque bars to move rotationally to engage the threads on either ends of the upper and lower SQUs (e.g., 202, 204, respectively) and make up, then tighten set screws. After rotation, the load collar 206 becomes mechanically coupled to the upper and lower SQUs (e.g., 202, 204, respectively) that keep the upper and lower SQUs coupled to one another.

As depicted in FIG. 8B, the upper SQU 202 may be formed with a mandrel 802. The mandrel 802 has a splined profile on an outer surface of the mandrel 802. The splined profile allows the mandrel 802 to align rotationally with an inner surface of the lower SQU 204 when the upper SQU 202 is positioned about the lower SQU 204. For example, when the upper SQU 202 is rotated relative to the lower SQU 204, the splined profile of the mandrel 802 engages an alignment key positioned on the inner surface of the lower SQU 204 that causes the mandrel 802 to rotate within the inner surface of the lower SQU 204 until the alignment key locks into place within the splined profile.

Figure 9A:
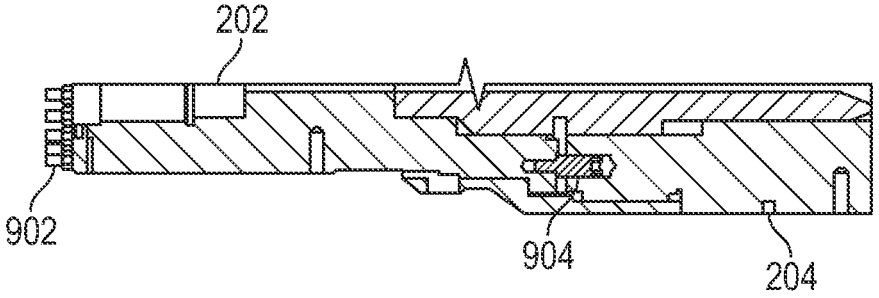
FIGS. 9A and 9B illustrate schematic views of the circumferential surface ports of the stabbable quick union in accordance with one or more implementations of the subject technology.
Figure 9B:
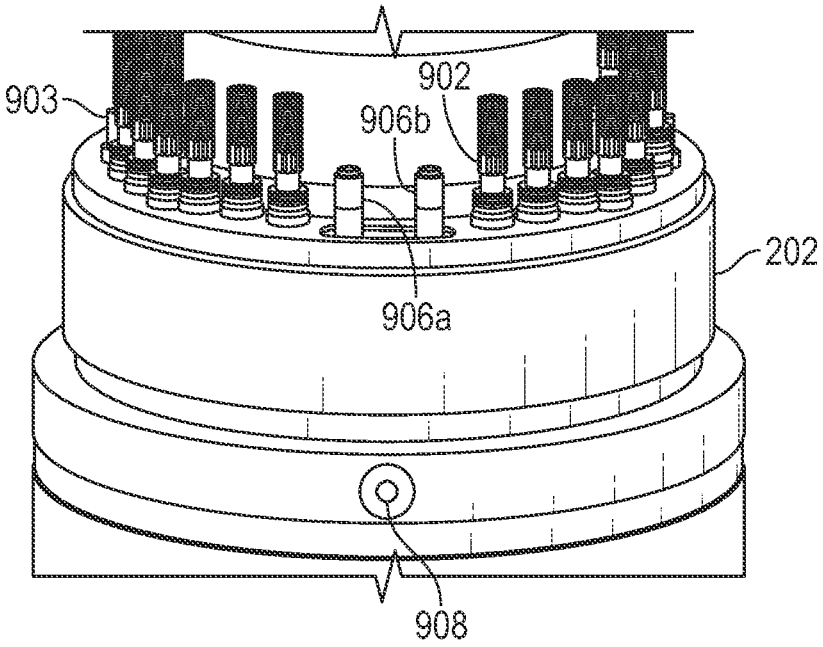

FIGS. 9A and 9B illustrate schematic views of the circumferential surface ports of the stabbable quick union 200 in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

As depicted in FIGS. 9A and 9B, on the bottom circumferential surface of the upper SQU 202 (e.g., facing the rotary table), there are fluid-checking stabs 902 that are designed to align to the counterpart surface on the lower SQU 204 using a stab guide.

The fluid-checking stabs 902 include a spring housed therein that is fully extended while the upper SQU 202 is disconnected from the lower SQU 204.

Each of the individual lines (e.g., 902, 903, 906*a, b*) has a specific function. The SQU 200 self-aligns itself in order to minimize (or prevent) cross-porting of the line functions.

The OD of the mandrel 802 (e.g., having splined feature) provides coarse rotational alignment, and the torque stabs provide fine rotational alignment. The OD of the upper SQU 202 is used for retention of the load collar 206.

In some aspects, there are three torque stabs (e.g., 904) located on the circumference edge of the upper SQU 202 (e.g., male end) that mate with female-end grooves arranged near the circumferential edge of the lower SQU 204. The torque stabs 904 operate to rotationally lock the SQU assembly.

When the upper and lower SQUs (e.g., 202, 204, respectively) are mated, electrical ports (e.g., 906*a*, 906*b*) arranged radially near the circumferential edge of the lower SQU 204 (e.g., male end) can be connected to the counterpart ends arranged radially near the circumferential edge of the upper SQU 202 to provide an electrical connection from the lower landing string (e.g., 520) to the upper landing string (e.g., including the EH 702) through the upper and lower SQUs (e.g., 202, 204, respectively).

The electrical ports 906*a*. 906*b* may include conduits with opposing conductive interfaces. The electrical connection can be made via the conductive interfaces. The conduits may be formed of a high-density plastic material or other insulating material.

In some implementations, a test port 908 is provided on the outer surface of the lower SQU 204 to test each of the hydraulic lines and/or the electrical lines. In some aspects, the hydraulic stab and bore seals are tested via the test port 908. In other aspects, an electrical test can be performed via the test port 908 to verify the electrical connections through the electrical ports 906*a*, 906*b*. In some aspects, the test port 908 allows for testing the seals on the electrical stabs.

Figure 10:
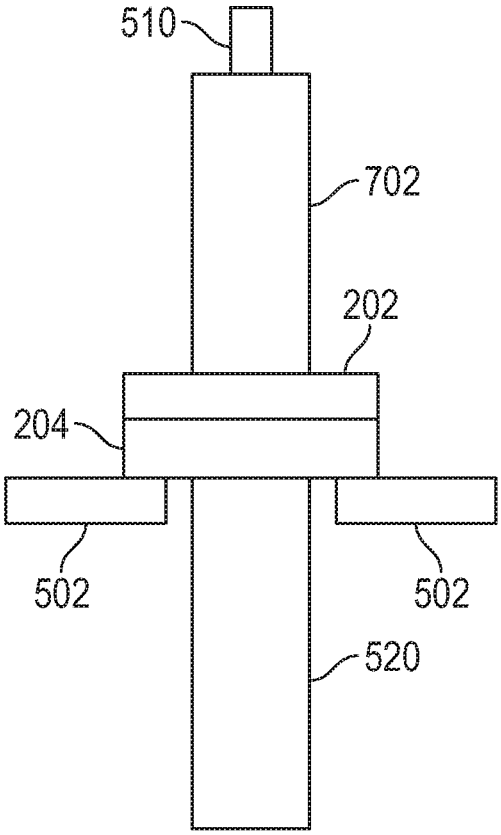
FIG. 10 illustrates a schematic view of the stabbable quick union connected to the electrohydraulic system on the rotary table prior to deployment in accordance with one or more implementations of the subject technology.

FIG. 10 illustrates a schematic view of the stabbable quick union 200 connected to the electrohydraulic system 702 on the rotary table 502 prior to deployment in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

As depicted in FIG. 10, the EH 702 (and the upper landing string) are fastened to the lower landing string 520 via the SQU 200 and while the SQU 200 is mounted on the c-plate 502 of the rotary table. To finalize connection, the hydraulic pressure on each of the lines (e.g., 402) is equalized from the top across the latch assist and through the upper and lower SQUs 202, 204, respectively. The valve (e.g., 404) for each line is then opened.

The top of the EH 702 is mechanically coupled to an umbilical (not shown). The umbilical is about 4 inches in diameter. The umbilical contains the hydraulic and electrical lines running there-through. The umbilical typically terminates at a top unit of the landing string assembly. In this case, the umbilical terminates at the top of the EH 702. Before the EH 702 is coupled to the landing string via the SQU 200, the umbilical may be coupled to the EH 702.

Figure 11:
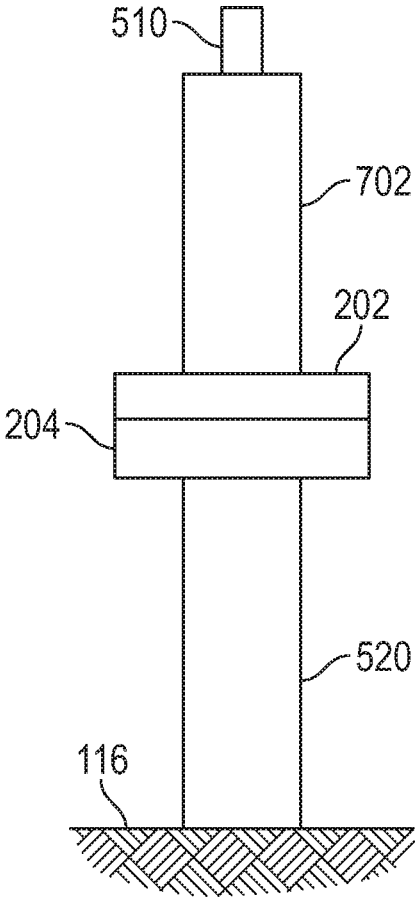
FIG. 11 illustrates a schematic view of the stabbable quick union connected to the electrohydraulic system on the rig floor prior to deployment in accordance with one or more implementations of the subject technology.

FIG. 11 illustrates a schematic view of the stabbable quick union 200 connected to the electrohydraulic system 702 on the rig floor 116 prior to deployment in accordance with one or more implementations of the subject technology. Not all of the depicted components may be used, however, and one or more implementations may include additional components not shown in the figure. Variations in the arrangement and type of the components may be made without departing from the spirit or scope of the claims as set forth herein. Additional components, different components, or fewer components may be provided.

The entire assembly (including the EH 702 and the lower landing string 520) is pulled up out of the c-plate 502 and rested on the rig floor 116 for testing. The entire landing string can be tested (e.g., bore test) while on the rig floor 116.

The tested assembly is then run-in-hole. When the assembly reaches the subsea interface (e.g., 102), there is a completion package that is configured to latch with the lower landing string 520. The system then operates as a data retrieval system once latched with the subsea interface. In some implementations, when the assembly is POOH, the process is performed in reverse.

Figure 12:
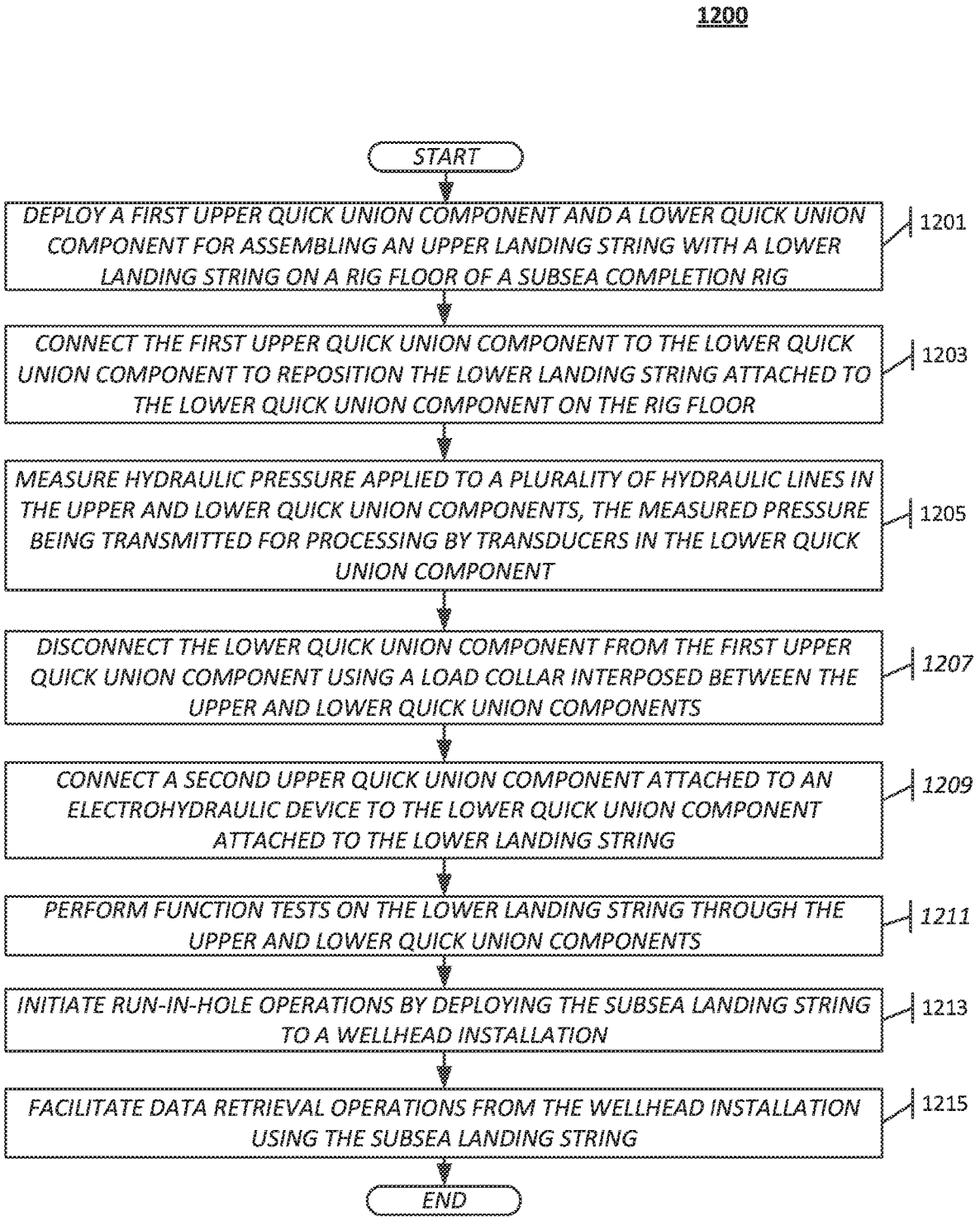
FIG. 12 illustrates a flowchart of a process for employing an electrohydraulic quick union for subsea landing string in accordance with one or more implementations of the subject technology.

FIG. 12 illustrates a flowchart of a process 1200 for employing an electrohydraulic quick union for subsea landing string in accordance with one or more implementations of the subject technology. Further for explanatory purposes, the blocks of the sequential process 1200 are described herein as occurring in serial, or linearly. However, multiple blocks of the process 1200 may occur in parallel. In addition, the blocks of the process 1200 need not be performed in the order shown and/or one or more of the blocks of the process 1200 need not be performed.

The process 1200 starts at step 1201, where a first upper quick union component (e.g., 202) and a lower quick union component (e.g., 204) are deployed for assembling an upper landing string with a lower landing string (e.g., 520) on a rig floor (e.g., 116) of a subsea completion rig (e.g., 100). Subsequently, at step 1203, the first upper quick union component (e.g., 202) is connected to the lower quick union component (e.g., 204) to reposition the lower landing string (e.g., 520) attached to the lower quick union component (e.g., 204) on the rig floor (e.g., 116). For example, a spare quick union device such as the first upper quick union component is used as a handling sub (with lift cap/handling joint installed) to lift the lower landing string to the rig floor in the vertical position.

Next, at step 1205, hydraulic pressure is applied to hydraulic lines in the first upper quick union component (e.g., 202) and the lower quick union component (e.g., 204) is measured. For example, the applied pressure may be monitored with wireless communication-based transducers (e.g., BLUETOOTH). The pressure may be applied to latch assist lines as needed. In some aspects, the latch assist lines are blocked in with built-in block valves (e.g., 404) of the lower quick union component (e.g., 204). The lower landing string may be set down onto the C-plate while the pressure is monitored.

Subsequently, at step 1207, the first upper quick union component (e.g., 202) is disconnected from the lower quick union component (e.g., 204) using a load collar (e.g., 206) interposed between the first upper quick union component (e.g., 202) and the lower quick union component (e.g., 204). For example, the first upper quick union component (e.g., 204) may be removed by removing lock pins and using torque rods installed to the load collar (e.g., 206). In this respect, the first upper quick union component may be set aside on the rig floor. The blocked pressure may be bled off from the block valves to equalize the pressure prior to disconnection. In some aspects, the lower landing string (e.g., 520) is kept mechanically coupled to the lower quick union component (e.g., 204) and repositioned on the rig floor (e.g., 116).

Next, at step 1209, a second upper quick union component (e.g., 202) attached to an electrohydraulic device (e.g., 702) is repositioned relative to the lower quick union component (e.g., 204) and connected to the lower quick union component (e.g., 204). In some aspects, the electrohydraulic device (with the second upper quick union component attached) is centered over the lower quick union component (e.g., 204), which is positioned on the C-plate with the lower landing string hanging below. The second upper quick union component is then stabbed into the lower quick union component, in which an alignment key aligns the upper and lower quick union components to the proper orientation. The load collar is threaded using the torque rods and set screws are tightened to complete the assembly of the second upper quick union component to the lower quick union component. Pressure is then applied to the latch assist lines to equalize pressure across the previously blocked block valves. The block valves may be reopened to regain control of the downhole functions. The electrohydraulic device (e.g., 702), which is now attached to the lower landing string (e.g., 520) via the upper and lower quick union components (e.g., 202, 204) is lifted up from the rig floor until the entire lower landing string is above the rotary table.

Subsequently, at step 1211, function tests on the lower landing string (e.g., 520) are performed through the upper and lower quick union components (e.g., 202, 204). Next, at step 1213, run-in-hole operations are initiated by deploying the assembled subsea landing string to the wellhead installation (e.g., 102). Further, at step 1215, data retrieval operations from the wellhead installation (e.g., 102) can be facilitated using the subsea landing string through the quick union device (e.g., 200). In some aspects, the aforementioned steps may be performed in reverse order during pull-out-of-hole operations and rig down event.

In some implementations, the process 1200 may include a step for actuating a valve (e.g., 318, 404) on each of the hydraulic lines (e.g., 324) in the lower quick union component (e.g., 204) to lock hydraulic pressure in the hydraulic lines. In some aspects, the lower quick union component (e.g., 204) is mechanically coupled to the lower landing string (e.g., 520) having a wellhead installation (e.g., 102) positioned on a subsea floor (e.g., 104). The process 1200 also includes a step for determining that the hydraulic pressure is locked by the valve (e.g., 318, 404) on each of the hydraulic lines (e.g., 324) using one or more transducers (e.g., 320, 406) in the lower quick union component (e.g., 204).

In connecting the second upper quick union component, the process 1200 may include a step for aligning the second upper quick union component (e.g., 202) relative to the lower quick union component (e.g., 204) using a self-aligning threaded interface (e.g., 302, 304) on each of the second upper quick union component (e.g., 202) and the lower quick union component (e.g., 204). The process 1200 also includes a step for mating the second upper quick union component (e.g., 202) to the lower quick union component (e.g., 204) via the load collar (e.g., 206) interposed between the second upper quick union component (e.g., 202) and the lower quick union component (e.g., 204).

In disconnecting the first upper quick union component, the process 1200 may include a step for releasing the hydraulic lines in the first upper quick union component (e.g., 202) and the lower quick union component (e.g., 204) such that the hydraulic pressure is balanced between the first upper quick union component (e.g., 202) and the lower quick union component (e.g., 204). In releasing the hydraulic lines, the process 1200 may include a step for releasing the valve (e.g., 318, 404) on each of the hydraulic lines (e.g., 324) when the first upper quick union component (e.g., 202) and the lower quick union component (e.g., 204) are mated to one another. In mating the first upper quick union component (e.g., 202) to the lower quick union component (e.g., 204), the process 1200 may include a step for rotating the first upper quick union component (e.g., 202) relative to the lower quick union component (e.g., 204).

In some implementations, the process 1200 may include a step for establishing electrical communication to the electrohydraulic device (e.g., 702) through one or more electrical lines (e.g., 310, 312, 314, 316) positioned in the first upper quick union component (e.g., 202) and the lower quick union component (e.g., 204). In some implementations, the process 1200 may include a step for transmitting one or more measurements associated with the hydraulic pressure using one or more transducers (e.g., 320, 406) powered by the one or more electrical lines (e.g., 310, 312, 314, 316). In some aspects, the one or more transducers (e.g., 320, 406) are positioned in respective housings in the lower quick union component (e.g., 204).

Various examples of aspects of the disclosure are described below. These are provided as examples, and do not limit the subject technology.

A system for serving as a connection interface between a lower landing string and an upper landing string is provided. The system includes a quick union device comprising a first quick union component that is operable to couple to the upper landing string and a second quick union component that is operable to couple to the lower landing string. In some aspects, the first quick union component and the second quick union component respectively include a self-aligning threading interface that have hydraulic and electrical connections and when the first and second quick union components are connected to one another provide hydraulic and electrical communication. In some implementations, the quick union device provides real-time feedback via wireless communication transducers that measure pressure and report the measured pressure in a plurality of hydraulic lines of the second quick union component when the first and second quick union components are disconnected from one another.

In some aspects, hydraulic pressure is applied to one or more latch assist lines through the second quick union component, and wherein the applied hydraulic pressure is locked by a valve operably coupled to the one or more latch assist lines.

In some aspects, the valve for each of the plurality of hydraulic lines is opened to allow hydraulic fluid to transfer between the first quick union component and the second quick union component.

The system also includes a transducer positioned in a housing along an outer surface of the second quick union component, wherein the one or more latch assist lines is communicably coupled to the transducer, in which the transducer is configured to obtain one or more measurements from the one or more latch assist lines, and the transducer is configured to send the obtained one or more measurements over a wireless network.

In some aspects, the one or more measurements associated with the one or more latch assist lines are broadcast via the transducer, in which the one or more measurements comprises one or more of hydraulic pressure data, temperature data or fluid properties, and the one or more measurements are sent to a client device connected to the wireless network.

In some aspects, hydraulic pressure on each of the plurality of hydraulic lines is equalized across the one or more latch assist lines and through the first and second quick union components to complete a connection.

In some aspects, the first and second quick union components are operable to be stabbed together with hydraulic communication to test each of the upper landing string and the lower landing string separately.

In some aspects, the quick union device comprises a load collar that mechanically couples the first quick union component to the second quick union component.

In some aspects, the load collar comprises plugs arranged circumferentially about an inner surface of the load collar that allows the load collar to traverse a portion of the first quick union component along a longitudinal length of the first quick union component and become positioned onto a curved profile on an outer surface of the first quick union component.

In some aspects, the load collar is mechanically fastened to the first quick union component and detached from the second quick union component such that the first quick union component can be disconnected from the second quick union component when the plugs are arranged within the curved profile.

In some aspects, the first quick union component is mechanically coupled to a first end of the load collar at a first end of the first quick union component.

In some aspects, the second quick union component is mechanically coupled to a second end of the load collar at a first end of the second quick union component.

In some aspects, the lower landing string is mechanically coupled to a second end of the second quick union component, and the lower landing string terminates into a tubing hanger running tool.

The system also includes an electrohydraulic device, in which the electrohydraulic device is mechanically coupled to a second end of the first quick union component at a first end of the electrohydraulic device.

In some aspects, the electrohydraulic device is mechanically coupled to the upper landing string at a second end of the electrohydraulic device.

In some aspects, the first quick union component includes a mandrel that includes a splined profile on an outer surface of the mandrel, in which the splined profile allows the mandrel to align rotationally with an inner surface of the second quick union component when the first quick union component is positioned about the second quick union component, and the splined profile of the mandrel engages a key positioned on the inner surface of the second quick union component that causes the mandrel to rotate within the inner surface of the second quick union component until the key is locked into place within the splined profile.

In some aspects, an outer diameter of the mandrel has the splined profile that provides coarse rotational alignment, and the quick union device comprises torque stabs arranged radially near circumferential edges of the first quick union component and the second quick union component that provide fine rotational alignment.

In some aspects, the quick union device comprises electrical ports positioned radially near a circumferential edge of the second quick union component that connect to counterpart ends arranged radially near a circumferential edge of the first quick union component to provide an electrical connection from the lower landing string to the upper landing string through the first and second quick union components when the first and second quick union components are mated.

A method of facilitating a connection of an electrohydraulic device to a subsea landing string is provided. The method includes deploying a first upper quick union component and a lower quick union component for assembling an upper landing string with a lower landing string on a rig floor of a subsea completion rig. The method also includes connecting the first upper quick union component to the lower quick union component to reposition the lower landing string attached to the lower quick union component on the rig floor. The method also includes measuring hydraulic pressure applied to a plurality of hydraulic lines in the first upper quick union component and the lower quick union component. The method also includes disconnecting the first upper quick union component from the lower quick union component using a load collar interposed between the first upper quick union component and the lower quick union component. The method also includes connecting a second upper quick union component attached to an electrohydraulic device as part of the upper landing string to the lower quick union component attached to the lower landing string for assembling the subsea landing string. The method also includes performing function tests on the lower landing string, and initiating run-in-hole operations by deploying the subsea landing string to a wellhead installation. The method also includes facilitating data retrieval operations from the wellhead installation using the subsea landing string.

In some aspects, the method also includes actuating a valve on each of the plurality of hydraulic lines in the lower quick union component to lock hydraulic pressure in the plurality of hydraulic lines, and determining that the hydraulic pressure is locked by the valve on each of the plurality of hydraulic lines using one or more transducers in the lower quick union component.

In connecting the second upper quick union component, the method includes aligning the second upper quick union component relative to the lower quick union component using a self-aligning threaded interface on each of the second upper quick union component and the lower quick union component, and mating the second upper quick union component to the lower quick union component via the load collar interposed between the second upper quick union component and the lower quick union component.

In disconnecting the first upper quick union component, the method includes releasing the plurality of hydraulic lines in the first upper quick union component and the lower quick union component such that the hydraulic pressure is balanced between the first upper quick union component and the lower quick union component.

In releasing the plurality of hydraulic lines, the method includes releasing the valve on each of the plurality of hydraulic lines when the first upper quick union component and the lower quick union component am mated to one another.

In mating the first upper quick union component to the lower quick union component, the method includes rotating the first upper quick union component relative to the lower quick union component.

The method also includes establishing electrical communication to the electrohydraulic device through one or more electrical lines positioned in the first upper quick union component and the lower quick union component.

The method also includes transmitting one or more measurements associated with the hydraulic pressure using one or more transducers powered by the one or more electrical lines, in which the one or more transducers are positioned in respective housings in the lower quick union component.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the subject technology. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B. and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims.

Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

Therefore, the subject technology is well adapted to attain the ends and advantages mentioned as well as those that are inherent therein. The particular embodiments disclosed above are illustrative only, as the subject technology may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the subject technology. The subject technology illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A system for serving as a connection interface between a lower landing string and an upper landing string, the system comprising:

a quick union device comprising a first quick union component that is operable to couple to the upper landing string and a second quick union component that is operable to couple to the lower landing string, wherein the first quick union component and the second quick union component respectively include a self-aligning threading interface that have hydraulic and electrical connections and when the first and second quick union components are connected to one another provide hydraulic and electrical communication, wherein the quick union device provides real-time feedback via wireless communication transducers that measure pressure and report the measured pressure in a plurality of hydraulic lines of the second quick union component when the first and second quick union components are disconnected from one another.

2. The system of claim 1, wherein hydraulic pressure is applied to one or more latch assist lines through the second quick union component, and wherein the applied hydraulic pressure is locked by a valve operably coupled to the one or more latch assist lines, and wherein the valve for each of the plurality of hydraulic lines is opened to allow hydraulic fluid to transfer between the first quick union component and the second quick union component.

3. The system of claim 2, further comprising:

a transducer positioned in a housing along an outer surface of the second quick union component, wherein the one or more latch assist lines is communicably coupled to the transducer, wherein the transducer is configured to obtain one or more measurements from the one or more latch assist lines, and wherein the transducer is configured to send the obtained one or more measurements over a wireless network, wherein the one or more measurements associated with the one or more latch assist lines are broadcast via the transducer, wherein the one or more measurements comprises one or more of hydraulic pressure data, temperature data or fluid properties, and wherein the one or more measurements are sent to a client device connected to the wireless network.

4. The system of claim 2, wherein hydraulic pressure on each of the plurality of hydraulic lines is equalized across the one or more latch assist lines and through the first and second quick union components to complete a connection.

5. The system of claim 1, wherein the first and second quick union components are operable to be stabbed together with hydraulic communication to test each of the upper landing string and the lower landing string separately.

6. The system of claim 1, wherein the quick union device comprises a load collar that mechanically couples the first quick union component to the second quick union component, wherein the load collar comprises plugs arranged circumferentially about an inner surface of the load collar that allows the load collar to traverse a portion of the first quick union component along a longitudinal length of the first quick union component and become positioned onto a curved profile on an outer surface of the first quick union component, and wherein the load collar is mechanically fastened to the first quick union component and detached from the second quick union component such that the first quick union component can be disconnected from the second quick union component when the plugs are arranged within the curved profile.

7. The system of claim 6, wherein the first quick union component is mechanically coupled to a first end of the load collar at a first end of the first quick union component, and wherein the second quick union component is mechanically coupled to a second end of the load collar at a first end of the second quick union component.

8. The system of claim 7, wherein the lower landing string is mechanically coupled to a second end of the second quick union component, and wherein the lower landing string terminates into a tubing hanger running tool.

9. The system of claim 7, further comprising an electrohydraulic device, wherein the electrohydraulic device is mechanically coupled to a second end of the first quick union component at a first end of the electrohydraulic device, wherein the electrohydraulic device is mechanically coupled to the upper landing string at a second end of the electrohydraulic device.

10. The system of claim 1, wherein the first quick union component comprises a mandrel that includes a splined profile on an outer surface of the mandrel, wherein the splined profile allows the mandrel to align rotationally with an inner surface of the second quick union component when the first quick union component is positioned about the second quick union component, and wherein the splined profile of the mandrel engages a key positioned on the inner surface of the second quick union component that causes the mandrel to rotate within the inner surface of the second quick union component until the key is locked into place within the splined profile.

11. The system of claim 10, wherein an outer diameter of the mandrel has the splined profile that provides coarse rotational alignment, and wherein the quick union device comprises torque stabs arranged radially near circumferential edges of the first quick union component and the second quick union component that provide fine rotational alignment.

12. The system of claim 1, wherein the quick union device comprises electrical ports positioned radially near a circumferential edge of the second quick union component that connect to counterpart ends arranged radially near a circumferential edge of the first quick union component to provide an electlical connection from the lower landing string to the upper landing string through the first and second quick union component& when the first and second quick union components are mated.

13. A method of facilitating a connection of an electrohydraulic device to a subsea landing string, the method comprising:

deploying a first upper quick union component and a lower quick union component for assembling an upper landing string with a lower landing string on a rig floor of a subsea completion rig;

connecting the first upper quick union component to the lower quick union component to reposition the lower landing string attached to the lower quick union component on the rig floor;

measuring hydraulic pressure applied to a plurality of hydraulic lines in the first upper quick union component and the lower quick union component;

disconnecting the first upper quick union component from the lower quick union component using a load collar interposed between the first upper quick union component and the lower quick union component;

connecting a second upper quick union component attached to an electrohydraulic device as part of the upper landing string to the lower quick union component attached to the lower landing string for assembling the subsea landing string;

performing function tests on the lower landing string;

initiating run-in-hole operations by deploying the subsea landing string to a wellhead installation; and facilitating data retrieval operations from the wellhead installation using the subsea landing string.

14. The method of claim 13, further comprising:

actuating a valve on each of the plurality of hydraulic lines in the lower quick union component to lock hydraulic pressure in the plurality of hydraulic lines: and determining that the hydraulic pressure is locked by the valve on each of the plurality of hydraulic lines using one or more transducers in the lower quick union component.

15. The method of claim 14, wherein connecting the second upper quick union component comprises:

aligning the second upper quick union component relative to the lower quick union component using a self-aligning threaded interface on each of the second upper quick union component and the lower quick union component; and mating the second upper quick union component to the lower quick union component via the load collar interposed between the second upper quick union component and the lower quick union component.

16. The method of claim 14, wherein disconnecting the first upper quick union component comprises:

releasing the plurality of hydraulic lines in the first upper quick union component and the lower quick union component such that the hydraulic pressure is balanced between the first upper quick union component and the lower quick union component.

17. The method of claim 16, wherein releasing the plurality of hydraulic lines comprises releasing the valve on each of the plurality of hydraulic lines when the first upper quick union component and the lower quick union component are mated to one another.

18. The method of claim 13, wherein mating the first upper quick union component to the lower quick union component comprises rotating the first upper quick union component relative to the lower quick union component.

19. The method of claim 13, further comprising:

establishing electrical communication to the electrohydraulic device through one or more electrical lines positioned in the first upper quick union component and the lower quick union component.

20. The method of claim 19, further comprising:

transmitting one or more measurements associated with the hydraulic pressure using one or more transducers powered by the one or more electrical lines, the one or more transducers being positioned in respective housings in the lower quick union component.

* * * * *